US005768782A

United States Patent [19]

Kato

[11] Patent Number: 5,768,782

[45] Date of Patent: Jun. 23, 1998

[54] FLAT TUBE FOR HEAT EXCHANGER AND METHOD FOR MANUFACTURING IT

[75] Inventor: Soichi Kato, Konan-machi, Japan

[73] Assignee: Zexel Corporation, Tokyo, Japan

[21] Appl. No.: 661,145

[22] Filed: Jun. 10, 1996

Related U.S. Application Data

[62] Division of Ser. No. 330,782, Oct. 28, 1994, abandoned.

[30] Foreign Application Priority Data

Oct. 29, 1993 [JP] Japan ..... 5-272234

[51] Int. Cl.[6] ..... B23P 15/00

[52] U.S. Cl. ..... 29/890.053; 29/890.054

[58] Field of Search ..... 29/890.053, 890.054, 29/505; 165/170, 166, 133, 179

[56] References Cited

U.S. PATENT DOCUMENTS

| | | | |
|---|---|---|---|
| 2,129,300 | 9/1938 | Bichowsky | 29/890.053 |
| 3,757,856 | 9/1973 | Kun | 165/166 X |
| 4,585,523 | 4/1986 | Giddings | 165/133 X |
| 5,318,114 | 6/1994 | Sasaki | 165/109.1 X |

FOREIGN PATENT DOCUMENTS

| | | | |
|---|---|---|---|
| 641577 | 7/1962 | Italy | 29/890.053 |
| 136093 | 8/1982 | Japan | 165/133 |
| 1046143 | 10/1966 | United Kingdom | 29/890.053 |

*Primary Examiner*—Irene Cuda
*Attorney, Agent, or Firm*—Kanesaka& Takeuchi

[57] ABSTRACT

A flat tube for use in a parallel flow type heat exchanger is formed by bending a single plate. The plate of a predetermined width is wound in a roll form and the plate is continuously drawn out from the roll. The continuously drawn out plate is provided with a projected portion which is swollen in a direction opposite the bending direction of the plate, the projected portion is pre-formed by a pair of vertically arranged forming rolls before the plate is bent. Thereafter, the plate is gradually bent, with the projected portion being the center, with increased bending angles by bending rolls provided at a plurality of stages, and the ends of the plate are butted to each other. Then, the projected portion is crushed by a mold roll while the ends of the plate are in the butted state, and thus formed tube is cut into a predetermined length thereby the flat tube is manufactured. The flat tube thus manufactured has the tube opening in laterally symmetrical shape, and, as a result, the orientation of the tube during assembly of the flat tube with the header tank is eliminated, which, in turn, improve the efficiency of assembly work of the flat tube and allows lowering of the manufacturing cost as well as to have an increased strength of the bent portion to provide a higher pressure resistance.

2 Claims, 5 Drawing Sheets

FLAT TUBE FOR HEAT EXCHANGER AND METHOD FOR MANUFACTURING IT

This application is a divisional of Ser. No. 08/330,782 filed Oct. 28, 1994, now abandoned.

PRIOR ART

Conventional flat tubes for use in a parallel flow type heat exchanger are known as disclosed in, for example, Japanese Patent Laid-Open Publications No. 57(1982)-136093 and No. 3(1991)-155422.

This type of flat tube is formed, as shown in FIG. 8, by bending a plate of a predetermined width at the center thereof (the bent portion becomes the side portion 11) by means of roll forming, and the ends 12, 12 are connected together by brazing, thereby to provide an opening having a cross-section of elliptical shape. At the same time, during roll forming, an array of inwardly protruding projections which are adapted to be in pressure contact with one another at their forward ends are formed by roll forming on both flat surfaces 10*a* of the flat tube 10. Due to presence of many such projections inside the tube, turbulence is caused in a heat-exchanger medium flowing through the tube. As a result, this allows to increase the heat exchanger efficiency on one hand, and, on the other hand, to increase the strength of the flat surface of the tube thereby to improve pressure resistance The conventional flat tube formed by bending the plate as described above has its opening in the elliptical form. As shown in FIG. 8, the form of the opening of flat tube 10 is such that one of the side portions 11 is formed in the U-shape, and the other side portion has its ends being projected sideways. Thus, such conventional flat tube formed by bending the plate has the opening in laterally asymmetrical to each other. Accordingly, a tube insertion hole provided in a header tank is required to be also formed in laterally asymmetrical to correspond with the form of the opening of flat tube.

With such forms of the opening of flat tube and the insertion hole of the header tank, both of which having the laterally asymmetrical shape, the tube insertion hole of the header tank is oriented during assembly of the flat tube by inserting it into the tube insertion hole of the header tank and brazing them together. Thus, the assembly of the flat tube with the header tank must be carried out by confirming a direction of assembly. Consequently, the efficiency of assembly work for assembling the flat tube with the header is deteriorated, which, disadvantageously results in lowering the productivity.

This type of flat tube is continuously formed from a material by a series of roll forming means, and there is a fear for causing the portion connecting the ends to open by the so-called springback phenomenon. In other words, the ends of the flat tube are disadvantageously turned over (the opening is widened) during insertion of the flat tube into the tube insertion hole of the header tank.

Another problem is that since the U-shaped portion (the side portion 11) of the flat tube has the weakest strength, this type of flat tube cannot be used in a condenser which requires a greater pressure resistance.

The present invention provides a flat tube for a heat exchanger which is free of being oriented during its assembly with the header tank, thereby to improve the efficiency of assembly work, which, in turn, results in lowering of manufacturing cost, and having the bent portion with an increased strength to allow improvement of pressure resistance; and a method of manufacturing such flat tube.

DISCLOSURE OF THE INVENTION

The present invention relates to a flat tube for a heat exchanger formed by bending a single plate at the center thereof and butting the ends of the plate to form the tube opening in an elliptical form, the flat tube is characterized in that a projected portion swollen in a direction opposite the bending direction is pre-formed at the center of said single plate, the plate is bent at the projected portion by roll forming, and the bent projected portion is crushed so as to provide the tube opening in lateral symmetry.

The present invention also relates to a method of manufacturing the flat tube, wherein the plate of a predetermined width is wound in a roll form, the plate is continuously drawn out from the roll, said continuous plate is provided with a projected portion swollen in a direction opposite the direction of bending the plate, said projected portion is pre-formed by a pair of vertically arranged forming rolls, thereafter, the plate is bent gradually, with the projected portion being at the center, with increased bending angles by bending rolls provided at a plurality of stages, the ends of the plate are butted to each other, whereupon the projected portion is crushed by a mold roll, while the ends of the plate are in the butted state, and the formed tube is cut into a predetermined length.

According to the flat tube and the method of manufacturing it of the present invention, the opening of the flat tube is formed laterally symmetrical, and, therefore, the tube insertion hole of the header thank can also be formed correspondingly in laterally symmetrical. Consequently, it eliminates the necessity of confirmation of an assembly direction during insertion of the flat tube into the tube insertion hole of the header tank. Thus, the efficiency of assembly work is improved, which, in turn, results in providing high productivity. Further, the portion connecting the ends of the tube is prevented from being opened, because the bent projected portion is crushed after roll forming. This allows smooth insertion of the flat tube into the tube insertion hole of the header tank during assembly of the flat tube with the header tank, thereby to improve the efficiency of assembly work. Moreover, the strength of the bent side is reinforced since a projection resulted from crushing of the projected portion is formed at the bent portion, so that the flat tube is made suitable for use in a condenser which requires a greater pressure resistance.

BRIEF DESCRIPTION OF THE DRAWINGS

FIGS. 1 to 7 illustrate an embodiment of the present invention wherein:

FIG. 1 is a perspective sectional view of the flat tube;

FIG. 2 is a plan view of the flat tube;

FIG. 3 is a front view of the flat tube;

FIG. 4 is a front view of the plate;

FIG. 5 is a front view of the tube insertion hole of the header tank;

FIG. 6 is a schematic diagram illustrating the manufacturing process;

FIGS. 7(*a*) to 7(*d*) are front views illustrating the process of forming the flat tube by means of bending rolls and mold roll.

DETAILED DESCRIPTION OF THE PREFERRED EMBODIMENT

Now an embodiment of the present invention will be described by referring to the accompanying drawings.

Figure 1:
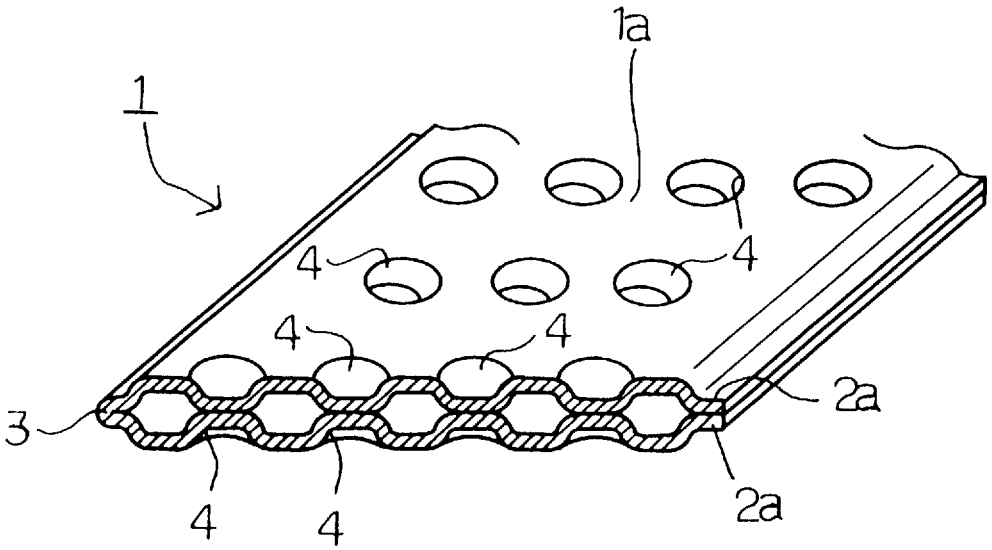

Referring to FIG. 1, a flat tube 1 of this embodiment is formed by bending the center of a single plate 2 so as to have an elliptical opening.

Figure 2:
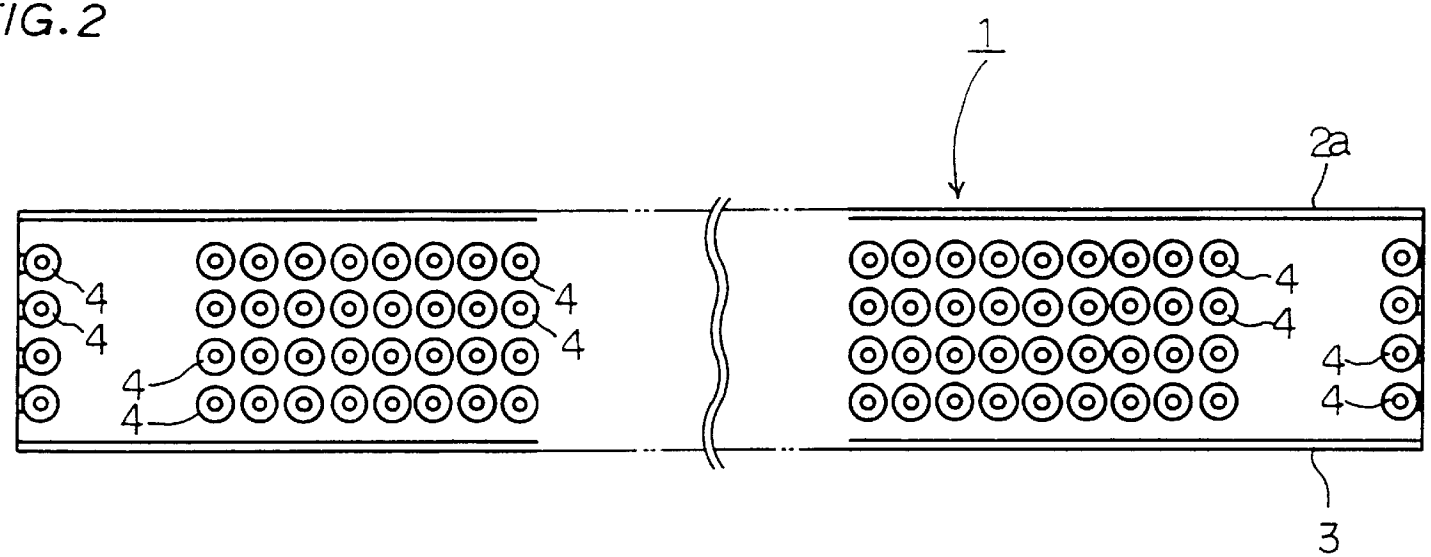
Figure 4:
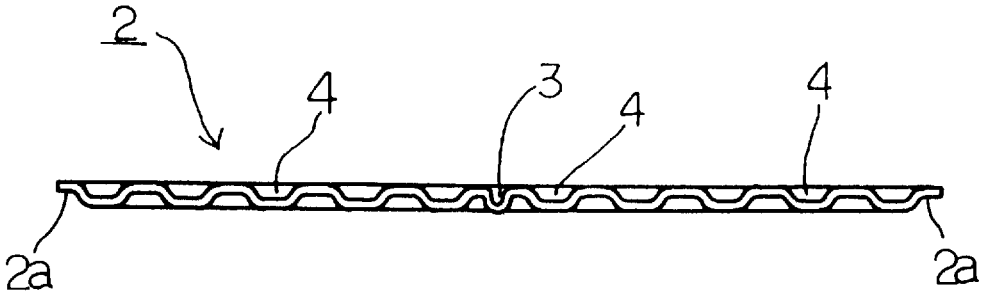

For the plate 2 which is the material of the flat tube 1, a material such as aluminum, aluminum alloy or the like is used. As shown in FIGS. 2 and 4, a U-shaped projected portion 3 which is swollen in a direction opposite the bending direction is pre-formed by roll forming at the center bending portion of the plate 2.

Further, the plate 2 is provided, at the portion to become a flat surface 1*a* of the flat tube 1, with an array of circular projections 4 pre-formed by roll forming, and the projections are swollen inwardly of the tube 1 and adapted to be in pressure contact with one another at the time of bending the plate at the projected portion 3. These circular projections 4 are not provided at the portion to be connected with a header tank which will be described hereinafter.

Figure 3:
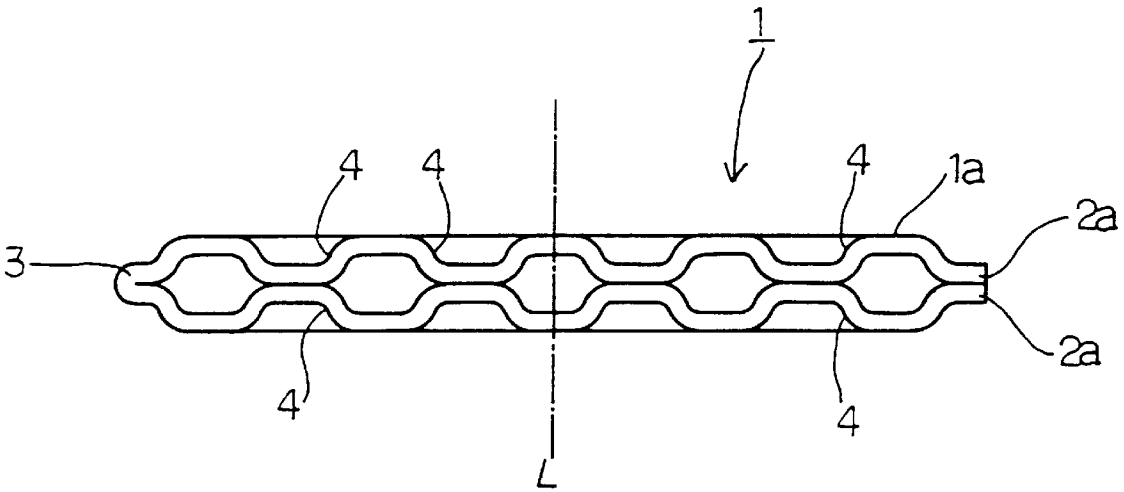

The plate 2 is then bent by roll forming in a direction opposite the swollen direction with the projected portion 3 of the plate 2 being the center. The ends of the plate 2 which has been bent at the projected portion 3 are butted to each other, and the projected portion 3 is crushed, so as to form the opening of the flat tube 1 laterally symmetrical with respect to the center line L, as shown in FIG. 3. Numerals 2*a,* 2*a* designate butted ends of the plate 2.

Figure 5:
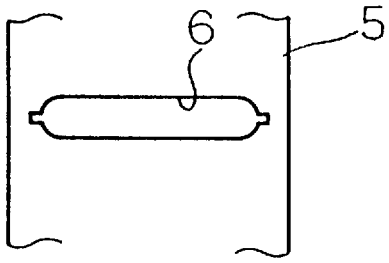

Referring to FIG. 5, a header tank 5 of the heat exchanger is provided with a tube insertion hole 6 in the form corresponding with the form of the opening of the flat tube 1. Each end of the flat tube 1 is inserted into the tube insertion hole 6 and assembled together by brazing.

Next, referring to FIG. 6, a process of manufacturing the flat tube 1 of laterally symmetrical will be described.

Figure 6:
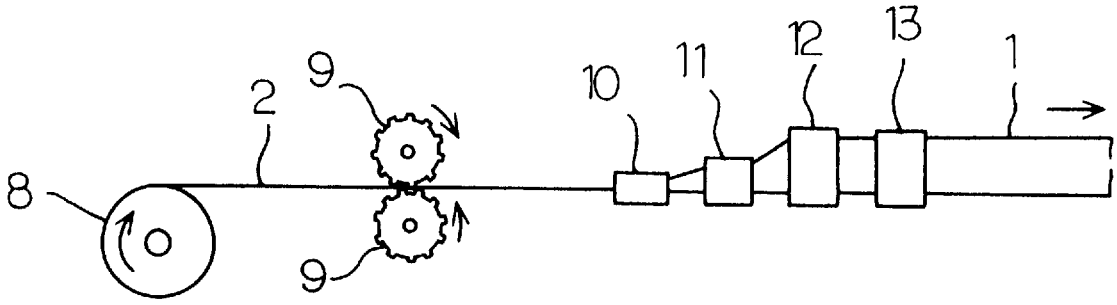
Figure 7A:
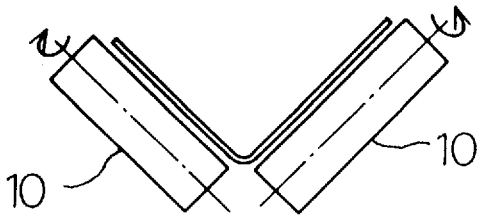
Figure 7B:
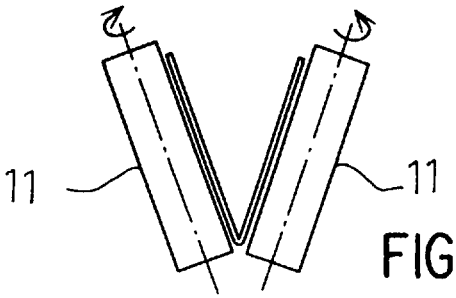
Figure 7C:
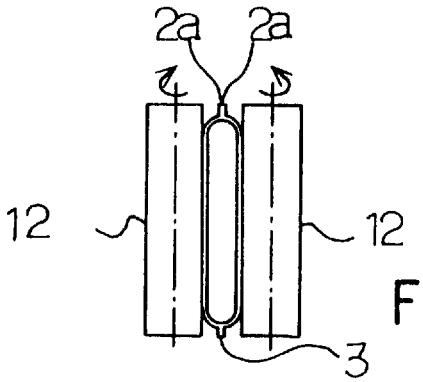
Figure 7D:
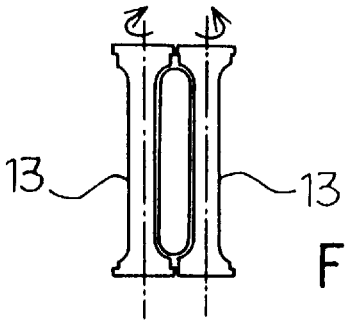
Figure 8:
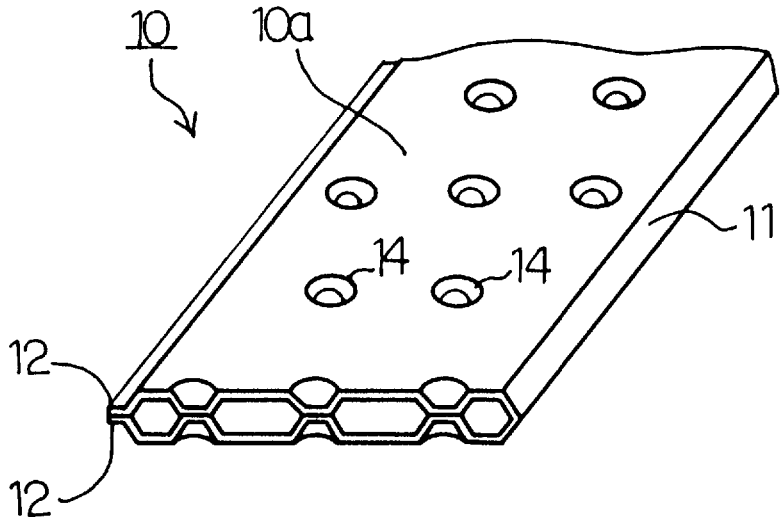
FIG. 8 is a perspective sectional view of a flat tube of prior art.

As shown in FIG. 6, a roll 8 of the plate 2 in a predetermined width which is the material of the flat tube is installed. The projected portion 3 and the array of circular projections 4 are pre-formed by a pair of vertically arranged forming rolls 9,9 on the plate 2 which is drawn out from the roll 8. Thereafter, the plate 2 is gradually bent with increased bending angles by bending rolls provided at a plurality of stages, as shown in FIGS. 7(*a*) to 7(*c*), and the ends 2*a* are butted to each other. Then, while the ends of the plate 2 being butted to each other, the bent projected portion 3 of the bent flat tube 1 is crushed by a mold roll 13, as shown in FIG. 7(*d*). Finally, the formed flat tube 1 is cut into a desired length according to the size of the heat exchanger, thereby the desired flat tube is obtained.

Thus, the flat tube of this embodiment has its opening in the lateral symmetry shape which continues in the longitudinal direction, and, the tube insertion hole of the header tank can also be formed in the lateral symmetry shape. This eliminates the necessity of confirming an assembly direction during insertion and assembly of the flat tube with the tube insertion hole of the header tank, and consequently the efficiency of assembly work is improved and productivity is increased.

Further, the portion connecting the ends of the tube is prevented from being opened, because the bent projected portion is crushed after roll forming. In other words, when the bent projected portion remains as is, the so-called spring back phenomenon occurs, but such occurrence of the spring-back phenomenon can be eliminated by crushing the projected portion.

The flat tube thus manufactured allows smooth insertion into the tube insertion hole of the header tank, thereby to improve the efficiency of assembly work. Moreover, a projection resulted from crushing of the projected portion is formed at the bent portion to provide reinforcement of the strength of the bent portion, which makes the flat tube possible to be used for the condenser which requires a greater pressure resistance.

What is claimed is:

1. A method of manufacturing a flat tube, comprising the steps of:

preparing a roll of a plate of a predetermined width;

drawing said plate of said roll through a pair of vertically arranged forming rolls to form a projected portion projected in a direction opposite to a bending direction of said plate and extending along a center line of said plate; and continuously bending said plate along said projected portion in a plurality of continuous stages of bending rolls so that opposite edges of said plate are finally butted to each other to form a tubular body, thereby maximizing a production efficiency; and cutting said tubular body into a predetermined length, thus providing a flat tube.

2. A method of manufacturing a flat tube according to claim 1, which further comprises the step of crushing said projected portion of said tubular body in a mold roll while said edges of said plate are in the butted state, thereby minimizing a spring back effect.

* * * * *